US008474184B2

(12) United States Patent
Wisbey

(10) Patent No.: US 8,474,184 B2
(45) Date of Patent: Jul. 2, 2013

(54) APPARATUS FOR REMOTELY OPENING A DOOR

(76) Inventor: Stephen Wisbey, Folkestone (GB)

( * ) Notice: Subject to any disclaimer, the term of this patent is extended or adjusted under 35 U.S.C. 154(b) by 685 days.

(21) Appl. No.: 12/542,168

(22) Filed: Aug. 17, 2009

(65) Prior Publication Data

US 2010/0071267 A1 Mar. 25, 2010

(30) Foreign Application Priority Data

Aug. 19, 2008 (GB) ..... 0815128.4

(51) Int. Cl.
*E06B 11/02* (2006.01)

(52) U.S. Cl.
USPC ..... 49/293; 49/279; 49/281; 49/297; 49/301; 49/324

(58) Field of Classification Search
USPC ..... 49/141, 279, 281, 289, 293, 297, 49/301, 324, 331, 332, 347, 139, 140
See application file for complete search history.

(56) References Cited

U.S. PATENT DOCUMENTS

| | | | | | |
|---|---|---|---|---|---|
| 513,913 | A | * | 1/1894 | Gasrland | 49/357 |
| 714,030 | A | * | 11/1902 | Reeves | 49/160 |
| 741,539 | A | * | 10/1903 | Peeples | 49/326 |
| 833,203 | A | * | 10/1906 | Coursey | 49/297 |
| 844,691 | A | * | 2/1907 | Russel | 49/300 |
| 1,040,967 | A | * | 10/1912 | Voght | 49/359 |
| 1,040,969 | A | * | 10/1912 | Voght | 49/359 |
| 1,095,924 | A | * | 5/1914 | Plumber | 49/160 |
| 1,201,313 | A | * | 10/1916 | Karuse | 49/359 |
| 1,223,956 | A | * | 4/1917 | Ganzenmuller | 49/301 |
| 1,267,307 | A | * | 5/1918 | Becker | 49/301 |
| 1,328,979 | A | * | 1/1920 | Becker | 49/301 |
| 1,603,722 | A | * | 10/1926 | Stanley | 292/255 |
| 1,605,728 | A | * | 11/1926 | Hiltz | 49/123 |
| 1,606,621 | A | * | 11/1926 | Fischer | 49/347 |
| 1,614,893 | A | * | 1/1927 | Manstad | 49/297 |

(Continued)

FOREIGN PATENT DOCUMENTS

| | | | |
|---|---|---|---|
| CA | 2543750 | * | 10/2006 |
| CA | 2543750 A1 | * | 10/2006 |
| GB | 0206614 | | 8/1922 |
| GB | 2228767 A | * | 9/1990 |

OTHER PUBLICATIONS

Search Report of GB0815128.4 dated Dec. 12, 2008.

*Primary Examiner* — Gregory J. Strimbu
(74) *Attorney, Agent, or Firm* — Hamilton, Brook, Smith & Reynolds, P.C.

(57) ABSTRACT

An apparatus and method for opening a door (48) from a remote location including a lever assembly (20) and a pulling line (22), the pulling line (22) having attached thereto a door handle engagement (60), the lever assembly (20) including at least a first guide (40) and a second guide (42) for guiding the pulling line (22) and a mounting apparatus (24) for mounting the lever assembly (20) to or adjacent a door (48), the first and second guides (40,42) being positioned such that when the pulling line (22) is prevented from moving through the first guide (40), pulling on the pulling line (22) acts to cause the lever assembly (20) to apply a force to urge the door to open (48). This apparatus allows an operator to gradually open a door or to apply a suitable force if, for example, the door (48) is stuck in the closed position.

7 Claims, 5 Drawing Sheets

U.S. PATENT DOCUMENTS

| | | | | |
|---|---|---|---|---|
| 1,965,725 | A * | 7/1934 | Smith et al. | 49/171 |
| 3,461,609 | A * | 8/1969 | Armstrong | 49/324 |
| 4,569,546 | A * | 2/1986 | Howard et al. | 292/336.3 |
| 4,924,626 | A * | 5/1990 | Ts'ao | 49/347 |
| 5,727,348 | A * | 3/1998 | Arnell et al. | 49/25 |
| 7,255,023 | B1 | 8/2007 | Heath | |
| 7,707,774 | B2 * | 5/2010 | Molnar et al. | 49/340 |
| 7,758,091 | B1 * | 7/2010 | McCall | 296/3 |
| 2010/0071265 | A1 * | 3/2010 | Molnar et al. | 49/280 |
| 2011/0192757 | A1 * | 8/2011 | Rometty et al. | 206/517 |

* cited by examiner

APPARATUS FOR REMOTELY OPENING A DOOR

CROSS REFERENCE TO RELATED APPLICATIONS

This application claims priority to United Kingdom Patent Application Number 0815128.4, filed Aug. 19, 2008, the entire teachings of which are hereby incorporated by reference.

BACKGROUND OF THE INVENTION

This invention relates to an apparatus for and method of remotely opening a door.

If there is a suspicion or knowledge that there is an unexploded device behind a door or the door is booby trapped it is desirable to open the door remotely, that is with the person opening the door positioned some distance away from the door, in case the act of opening the door triggers the unexploded device.

Remote opening of a door is relatively straightforward if the door opens towards the operator's side of the door. For example, a rope can be attached to the door handle which when pulled activates the door handle to unlatch the door which can then be opened by further pulling on the rope. Such a technique is not possible, however, if the door opens away from the operator's side of the door.

A known approach to the latter situation is disclosed in CA-A-2,543,750 which discloses a remote door opening apparatus that includes a support bar having a lever arm which can be urged outwards by a gas cylinder. A pulling line extends from a remote operator position to a guide on the support bar up to a door handle and is looped through a release pin. When the pulling line is pulled the line acts to unlatch the door handle. Once unlatched continued pulling of the pulling lines pulls out the release pin so releasing the lever arm which is moved to a position at right angles to the support bar. Alternatively, the pin could be released before door handle is unlatched.

This known device applies a predetermined force to the door and operates to immediately extend the lever arm to the most extended position. There are, however, circumstances when it is desirable to gradually open a door or to apply a greater force than is expected to be needed, e.g. if the door is stuck in the closed position.

SUMMARY OF THE INVENTION

In a preferred embodiment, an apparatus is provided for opening a door from a remote location which provides these additional capabilities.

In a first aspect, an apparatus for opening a door from a remote location including a lever assembly and a pulling line, the pulling line having attached thereto a door handle engagement, the lever assembly including at least a first guide and a second guide for guiding the pulling line, and a mount for mounting the lever assembly to or adjacent a door, the first and second guides being positioned such that when the pulling line is prevented from moving through the first guide by the door handle, wherein further pulling on the pulling line acts to cause the lever assembly to apply a force to urge the door to open.

The rate and degree of opening of the door, and the force applied to open the door, can be adjusted by adjusting the manually applied pulling force on the line.

The mount may be a support bar, preferably a telescopic support bar, that can be fixed between a pair of door frame jambs on which the lever is pivotally mounted. Alternatively, the mount may attach the lever assembly to a door.

The lever assembly may include a first elongate lever arm and a second elongate lever arm connected at an angle to the first arm, the first and second guide means being positioned towards the outer ends of the first and second lever arms. Optionally, a third guide may be positioned at the intersection of the first and second lever arms, for example. In either case, the lever may be pivotally mounted on the support bar at the intersection of the first and second lever arms.

Conveniently, the guides are pulleys.

A brace arm may be connected between the first and second lever arms and the apparatus may be foldable, the brace arm and the lever arms being connected such that one lever arm and the brace arm can be moved to substantially within the other lever arm.

In other aspects, a method for remotely opening a door may comprise:

mounting a least one guide to or adjacent a door handle, the guide generally vertically aligned with the door handle, engaging the door handle such that when the pulling line is pulled through the first guide, the door handle is moved to an unlatched position; and pulling the pulling line from a remote position so as to first move the door handle to the unlatched position and thereafter to apply an opening force to the door.

BRIEF DESCRIPTION OF THE DRAWINGS

Embodiments of the invention will now be described, by way of example only, with reference to the accompanying drawings, of which.

DETAILED DESCRIPTION OF PREFERRED EMBODIMENTS

A description of example embodiments follows.

Figure 1:
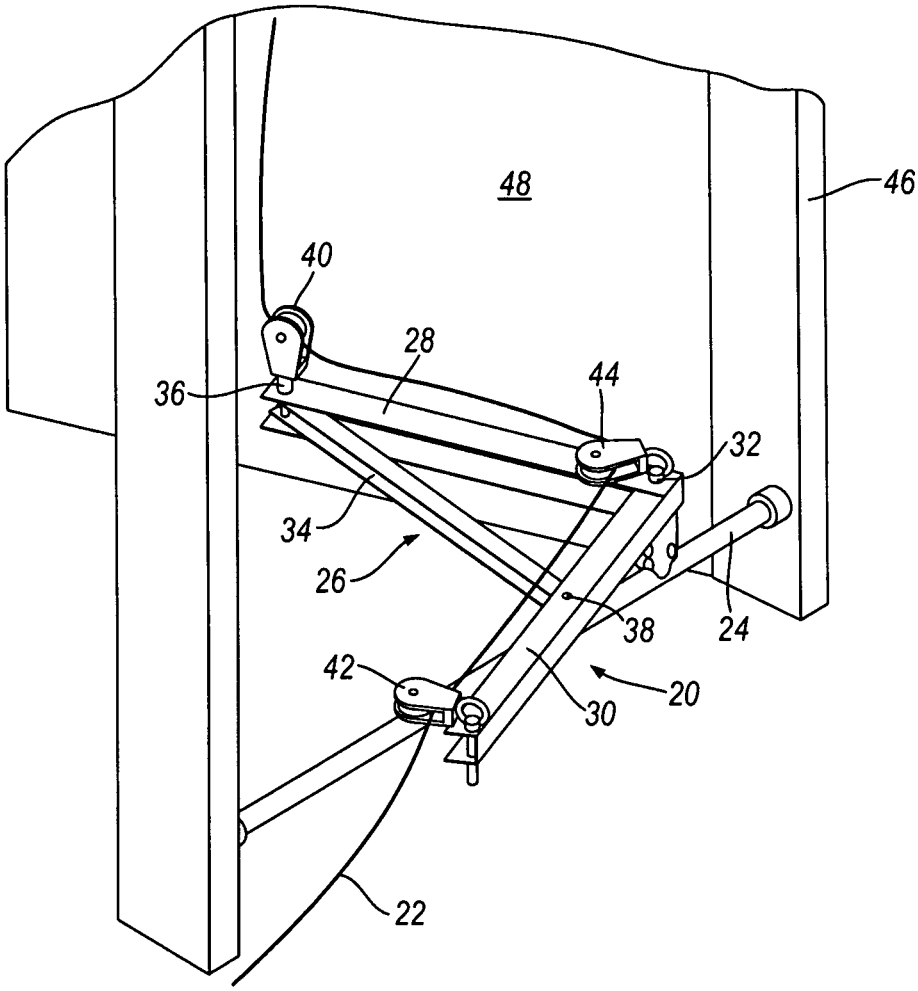
FIG. 1 is a schematic perspective view of a first embodiment of the present invention.
Figure 2:
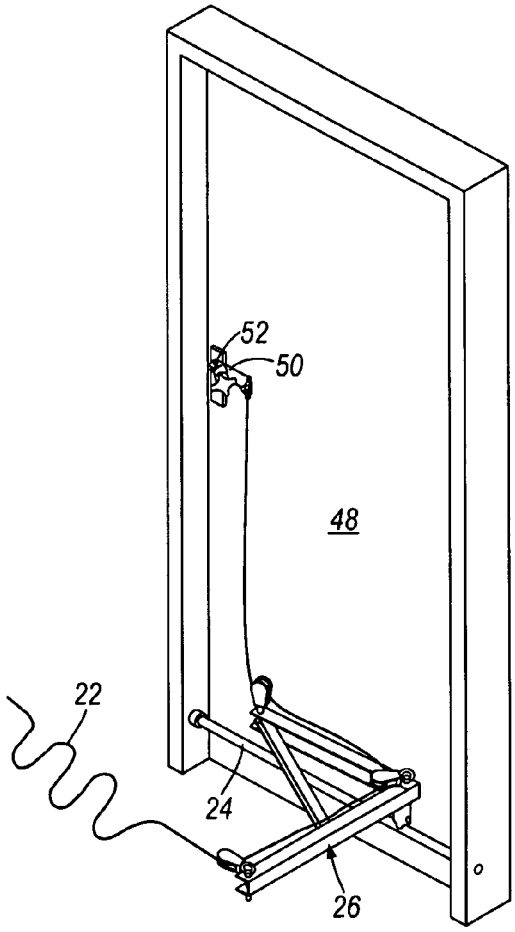
FIGS. 2 to 5 are a series of schematic views showing the operation of the operation of the embodiment of FIG. 1.

Referring to FIG. 1 there is shown a first embodiment which includes a lever assembly 20 and a pulling line 22, for example a light rope.

The lever assembly 20 includes a telescopic support bar 24 on which is pivotally mounted a lever frame 26 having first and second lever arms 28 and 30 pivotally connected at a pivot 32 and held at right angles to each other by a brace 34 pivotally attached to the first arm at pivot 36 and removably attachable to the second lever arm by a pin 38. When the brace 34 is detached from the first and second lever arms 28, 30, the brace and two lever arms can be folded to a mutually nested position.

The lever frame 26 is pivotally mounted on the support bar 24 so it can pivot relative to the support bar whist moving in a plane parallel to the support bar, which is in the horizontal plane when the support bar is mounted horizontally as shown in FIG. 1.

The lever frame 26 also includes first and second pulleys 40, 42 at the outer ends of the lever arms 28 and 30, respectively, (and constituting the first and second guide means) and a pulley 44 at the pivot 32 through which pulling lines 22 is guided. The pulley 44 is optional. Pulley 40 guides the pulling line 22 from the horizontal plane and approximately vertically up to the door handle and pulley 42 guides the pulling line from pulley 40 to pulley 42 in the horizontal plane.

The support bar 24 is fixed in position between the jambs of a door frame 46 in which a door 48 is hung.

Figure 3:
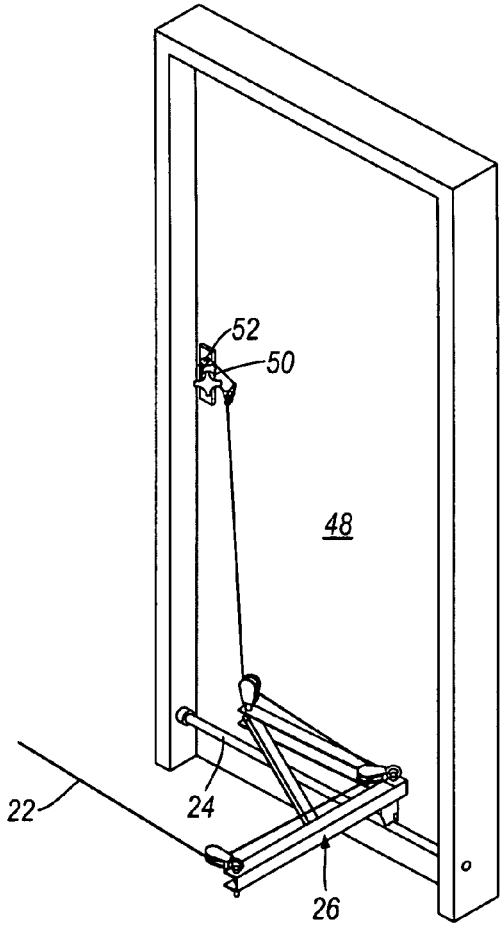
Figure 4:
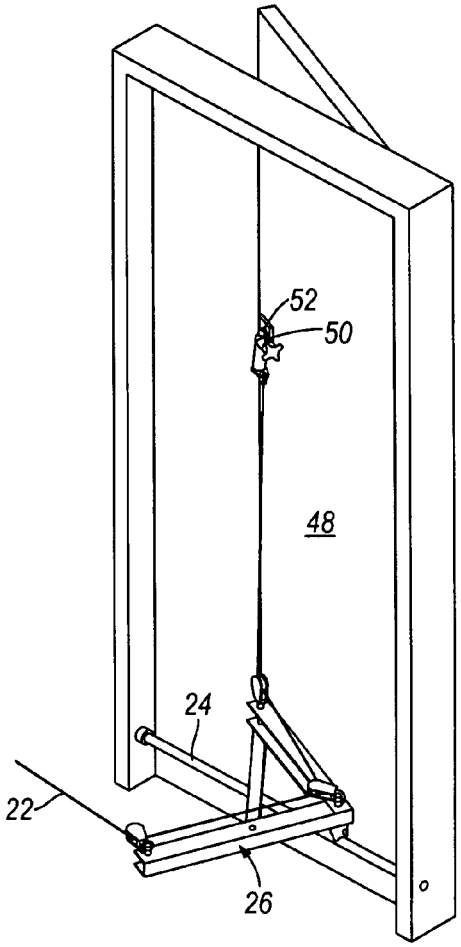
Figure 5:
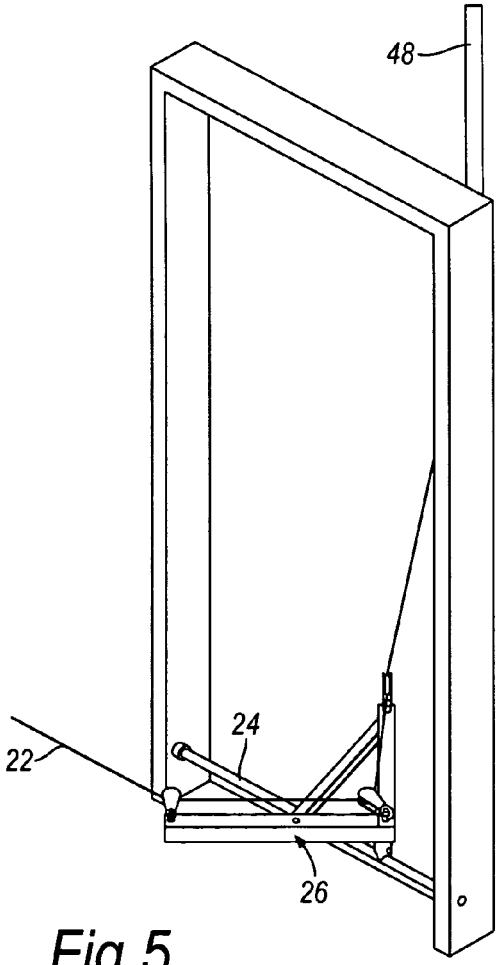

Referring now to FIGS. 2 to 5, there is shown the apparatus of FIG. 1 in which a handle engagement is attached to the door handle 52 of the door 48. The door 48 is closed in FIG. 2, the door handle 52 is in the latched position and the pulling line 22 is loose. When the line 22 is pulled, the lever frame is braced against the latched door so the force applied to the line acts to unlatch the door 48 by pulling the door handle down to the unlatched position as shown in FIG. 3. If the line 22 is pulled further because the end of the line 22 is now held by the door handle the force applied to the line will act to rotate the lever frame 26 and open the now unlatched door 48 as shown in FIG. 4. As soon as the door 48 is ajar the line 22 can be released, if desired, and the door then edged slowly open even if the force applied is no longer sufficient to hold the door handle in the illustrated unlatched position. If desired the lever frame 26 can be pivoted as far as the direction of pull on the line 22 will allow as shown in FIG. 5.

Figure 6:
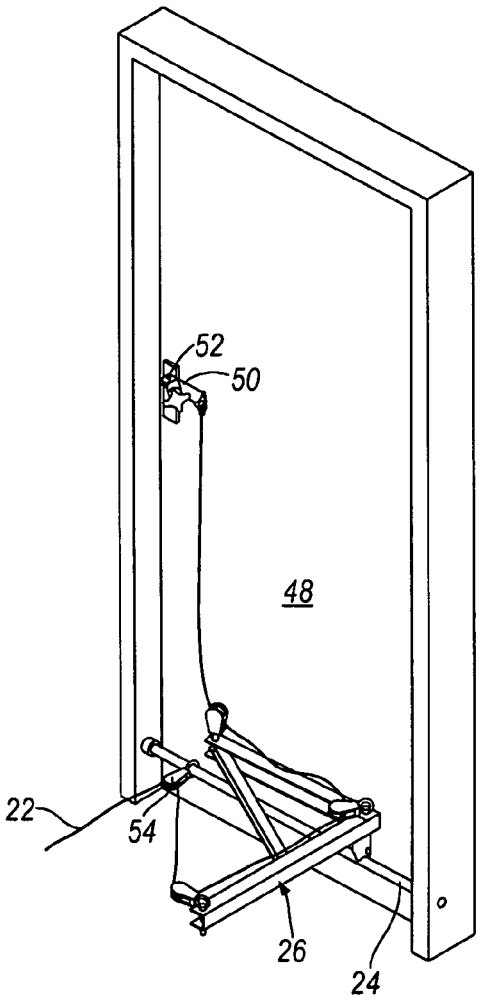
FIG. 6 is a schematic illustration of a further embodiment of the present invention.

If it is desired to pull in a direction other than approximately parallel to the support bar 24, then a further guide 54, e.g., a pulley, can be attached to the support bar 54 to redirect the line 22 as shown in FIG. 6, for example.

It will be appreciated that the pulley 44 (see FIG. 1) is optional and is used in this embodiment to provide a convenient placement of the line 22 in relation to the lever frame 26.

Figure 7:
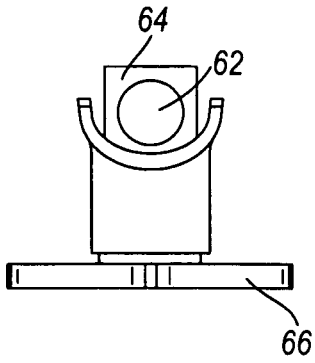
FIGS. 7 and 8 are schematic illustrations of a door handle engagement tool useful with the present invention.
Figure 8:
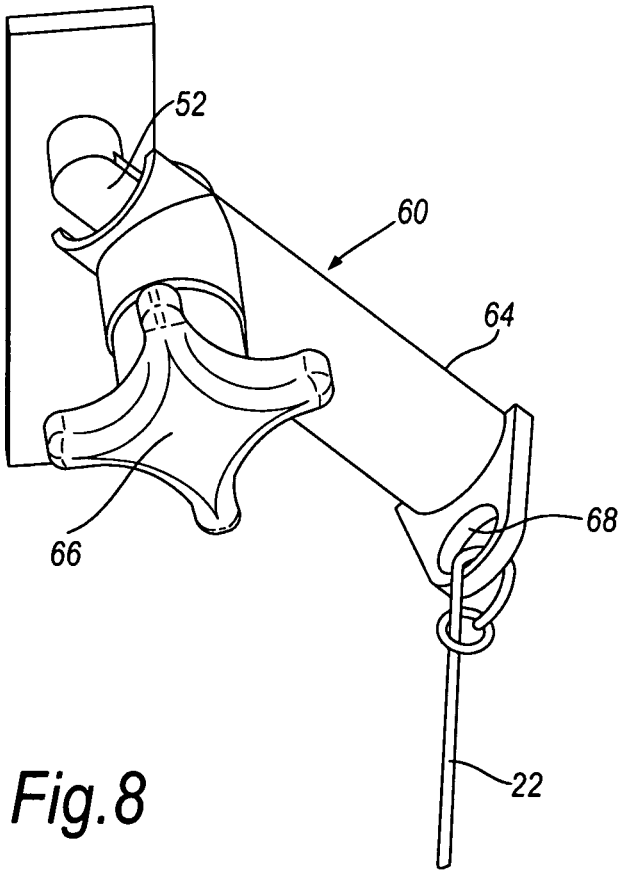

Referring now to FIGS. 7 and 8 there is shown a door handle half-sleeve 60 which can be fixed to a door handle. The handle passes through a hole 62 in a locking member 64 which can be pulled towards a semi-cylindrical half-sleeve 64 to lock the handle 62 to the half-sleeve 64 on turning the knob 66. Line 22 is attached to an eye 68 so the unlatching torque can be applied to the handle 22.

Figure 9:
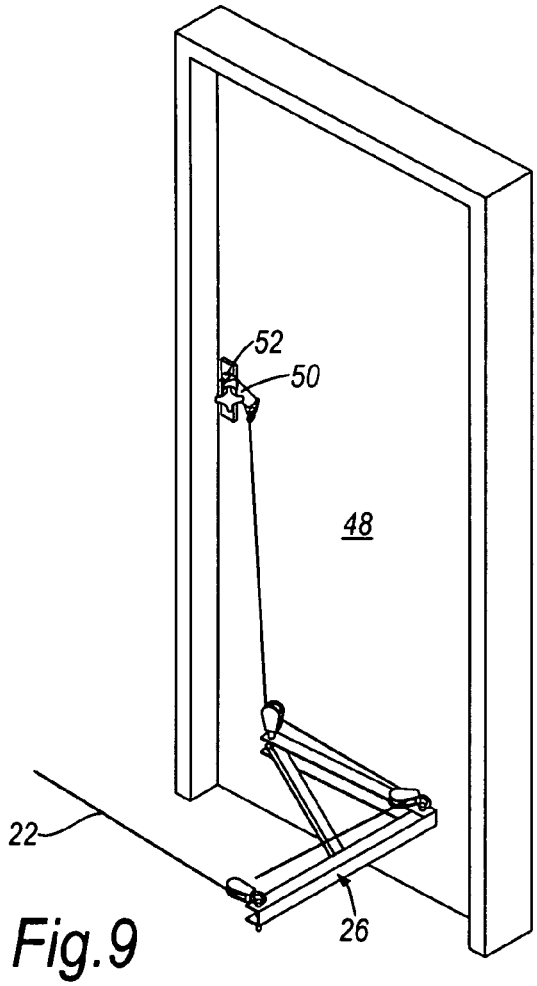
FIG. 9 is a schematic illustration of a further embodiment of the present invention.

FIG. 9 shows a further embodiment having a lever frame 26 which is as in the embodiments of FIGS. 1 to 5 and 6 but which is attached directly to the door 48 by, for example, screws fittings rather than being supported adjacent the door by a support bar. The operation of the apparatus of FIG. 9 is as in that of the previously described embodiments or any other suitable method, eg double-sided tape, glue, etc., except that the lever frame will pivot inwardly with the door 48 as it opens.

A line-locking mechanism, e.g., a one-way locking pulley, through which the line 22 passes after leaving the guides of the lever assembly can be used to lock the door 48 in the open position, e.g., against the action of an automatic closing mechanism. This could be implemented by using a locking pulley as pulley 54 in the embodiment of FIG. 6, for example.

One of the pulleys (40, 42, 44) of the lever assembly may, independently, be a locking pulley which would then hold the door handle in the unlatched position even if the pulling force on the line 22 was removed. It will be appreciated that alternative line-locking mechanisms may be used instead of a particular locking pulley, for example a cleat.

While this invention has been particularly shown and described with references to example embodiments thereof, it will be understood by those skilled in the art that various changes in form and details may be made therein without departing from the scope of the invention encompassed by the appended claims.

What is claimed is:

1. An apparatus for opening a door from a remote location, the apparatus comprising:

a lever assembly and a pulling line;

the pulling line arranged to engage a door handle of the door;

the lever assembly including at least a first guide and a second guide for guiding the pulling line, the lever assembly further including a lever frame having a first elongate lever arm and a second elongate lever arm connected at an angle to the first arm at a connection, the first and second lever arms each having an outer end opposite to the connection, the first and second guides respectively being positioned adjacent the outer ends of the first and second lever arms, the lever frame pivotally mounted to a mount;

the first and second guides being positioned such that when the pulling line is prevented from moving through the first guide by the door handle, further pulling on the pulling line acts to apply a force to the first guide which causes the lever assembly to rotate and apply a force to urge the door to open.

2. An apparatus as claimed in claim 1, wherein the mount is a telescopic support bar fixable between jambs of a door frame.

3. An apparatus as claimed in claim 2, in which the mount attaches the lever assembly to the door frame.

4. An apparatus as claimed in claim 1, including a third guide positioned adjacent to the connection of the first and second lever arms.

5. An apparatus as claimed in claim 1, in which the guides are pulleys.

6. An apparatus as claimed in claim 1, including a brace arm connectable between the first and second lever arms.

7. An apparatus as claimed in claim 6, in which the brace arm and the lever arms are connected such that one of said lever arms and the brace arm can be moved to lie substantially within the other lever arm.

* * * * *